US006673185B1

(12) United States Patent
Beduhn et al.

(10) Patent No.: US 6,673,185 B1
(45) Date of Patent: Jan. 6, 2004

(54) PROCESS FOR SPLICING BLOCKS OF MULTI-LANE FESTOONED MATERIAL

(75) Inventors: Mark W. Beduhn, Menasha, WI (US); Kent E. Kordsmeier, Neenah, WI (US); Rodney L. Abba, Oshkosh, WI (US); Robert J. Makolin, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 35 days.

(21) Appl. No.: 10/027,786

(22) Filed: Dec. 20, 2001

(51) Int. Cl.[7] ..... B65H 69/06

(52) U.S. Cl. ..... 156/157; 156/304.1; 428/57; 270/39.05

(58) Field of Search ..... 156/157, 159, 156/304.1; 428/59; 270/39.01, 39.05

(56) References Cited

U.S. PATENT DOCUMENTS

| | | | | |
|---|---|---|---|---|
| 3,607,506 A | * | 9/1971 | Gerwin et al. | 156/157 |
| 4,022,396 A | * | 5/1977 | Manchester et al. | 242/160.2 |
| 4,240,854 A | * | 12/1980 | Massey et al. | 156/157 |
| 4,576,673 A | * | 3/1986 | Lenzi | 156/350 |
| 4,770,366 A | * | 9/1988 | Hood et al. | 242/128 |
| 5,036,977 A | | 8/1991 | Schofield et al. | |
| 5,092,573 A | * | 3/1992 | Abreu | 270/52.08 |
| 5,219,126 A | * | 6/1993 | Schutz | 242/560 |
| 5,962,105 A | | 10/1999 | Pottenger | |
| 6,035,608 A | | 3/2000 | O'Connor | |
| 6,263,814 B1 | * | 7/2001 | O'Connor | 112/401 |

FOREIGN PATENT DOCUMENTS

| | | |
|---|---|---|
| DE | 19956846 A1 | 5/2001 |
| WO | WO 0138215 A1 | 5/2001 |
| WO | WO 0142119 A1 | 6/2001 |

* cited by examiner

*Primary Examiner*—Mark A. Osele
(74) *Attorney, Agent, or Firm*—Dority & Manning

(57) ABSTRACT

A process is provided for splicing multiple blocks of multi-lane festooned material. The tail ends of stacks from a first block are spliced to lead ends of stacks from a second block, and the tail ends of the stacks in the second block are spliced with the lead ends of stacks in the first block or another block.

17 Claims, 4 Drawing Sheets

PROCESS FOR SPLICING BLOCKS OF MULTI-LANE FESTOONED MATERIAL

BACKGROUND OF THE INVENTION

The present invention relates to blocks of festooned material, and in particular to a process for splicing and feeding the material from multiple blocks in a manufacturing process.

The concept of festooning materials is widely known and used in packaging many different types of materials for subsequent supply to a machine or manufacturing process. In many instances, festooning has advantages over supplying the material in the form of a wound package or roll. For example, with festooned packages, there is no need for complex and costly unwind devices. The festooned packages are easily transportable and can be located directly adjacent to a manufacturing machine. Unlike wound or roll packages, tension control of the festooned material is generally not an issue. Festooning has found particular favor in the packaging of fibrous non-woven strips of material.

With festooning, the material strip is typically laid down into a container or on a base in a traversing back-and-forth manner such that a length of the strip is folded into an individual "stack" or "lane." The stacks may be horizontally or vertically disposed. Multiple adjacent stacks may be provided in a single package in parallel side-by-side fashion with each stack having its own leading end and tail end. Such packages are conventionally referred to as "multi-lane" festooned "blocks." These block configurations are particularly useful in the manufacture of disposable absorbent articles such as diapers, feminine care products, incontinence products, and the like, wherein strips of absorbent core material must be quickly and efficiently fed into the manufacturing line.

In order to provide a generally continuous supply of the festooned material in a manufacturing process, it is necessary to repeatedly splice the tail end of one stack with the leading end of another stack. This has typically been done by connecting stacks within a block by splicing the tail end of one stack with the leading end of the adjacent stack such that all of the stacks within a block are exhausted before another block is spliced into the process. Reference is made, for example, to U.S. Pat. No. 6,035,608 and WO 01/42119.

The present invention relates to an alternate process for splicing and feeding festooned stacks from multiple blocks.

SUMMARY

Objects and advantages of the invention will be set forth in part in the following description, or may be obvious from the description, or may be learned through practice of the invention.

The present invention provides a process for splicing and feeding festooned material from multi-lane blocks of the material. The process includes providing a first multi-lane block of side-by-side stacks of the material with each stack having a leading end and a tail end. At least one additional multi-lane block of side-by-side stacks of the material is located in close proximity to the first block, each stack in the second block having a leading end and a tail end. The blocks may be oriented with respect to each other in any pattern or configuration. For example, the blocks may be arranged one above the other in a vertical configuration, or disposed generally in the same horizontal plane.

It should be appreciated that the present process is not limited to any particular configuration of multi-lane block.

For example, the blocks may be essentially free-standing wherein the stacks are generally laid down onto a base member but are otherwise unsupported. With this configuration, the blocks are typically wrapped with a film or other suitable material until they are to be used. In alternate embodiments, the blocks may include any manner of support structure, cage structure, walls, etc. It is only necessary that the blocks allow for some way to connect or splice the tail ends and lead ends of the stacks in each block, desirably from the same side of the blocks.

In one embodiment, the process further involves splicing the tail end of the first stack of the first block to the leading end of the first stack of a second block, and splicing the tail end of the first stack of the second block to the leading end of the second stack of the first block, and so forth. The splicing sequence is repeated for subsequent stacks until all of the stacks of the first block and the second block have been alternately spliced such that tail ends of the stacks in the first block are spliced with the lead ends of the stacks in the second block, and the tail ends of the stacks in the second block are spliced with the lead ends of the stacks in the first block. A lead end of the first stack of the first block is delivered to a manufacturing line and the spliced stacks are consumed in alternating fashion between the blocks. This embodiment may be used if all of the stacks from the multiple blocks are to be fed to the same machine or manufacturing process.

In an alternate embodiment, multiple blocks may be spliced to supply multiple machines. Due to material variances between stacks of a block, it may be desired to feed certain stacks to one machine or process and certain other stacks within the same blocks to a different machine or process. The present splicing method is particularly well suited to accommodate this situation. For example, in one embodiment, the middle stacks of the multiple blocks may be spliced together in accordance with the present method and supplied to one machine while the outer stacks of the same blocks may be sliced together and supplied to another machine. Numerous variations of this concept are obviously available.

It should be appreciated that any number of blocks may be spliced together in accordance with the present process. For example, three blocks may be spliced wherein the tail end of the first stack of block one is spliced to the lead end of the first stack of block two. The tail end of the first stack of block two is spliced to the lead end of the first stack of block three. The tail end of the first stack of block three is spliced to the lead end of the second stack of block one. The sequence is repeated until all of the stacks in the blocks are alternately connected.

The inventive process also may include splicing the tail end of the last stack of the last block to an additional source of festooned material. This additional source may be, for example, additional blocks of multi-lane side-by-side stacks spliced together in accordance with the invention. These additional blocks may be spliced together as the first set of blocks is being consumed in the manufacturing process. The additional blocks are then moved to the manufacturing line and spliced to the tail end of the last stack of the last block.

The invention will be explained below with reference to the attached figures.

DETAILED DESCRIPTION

Figure 1:
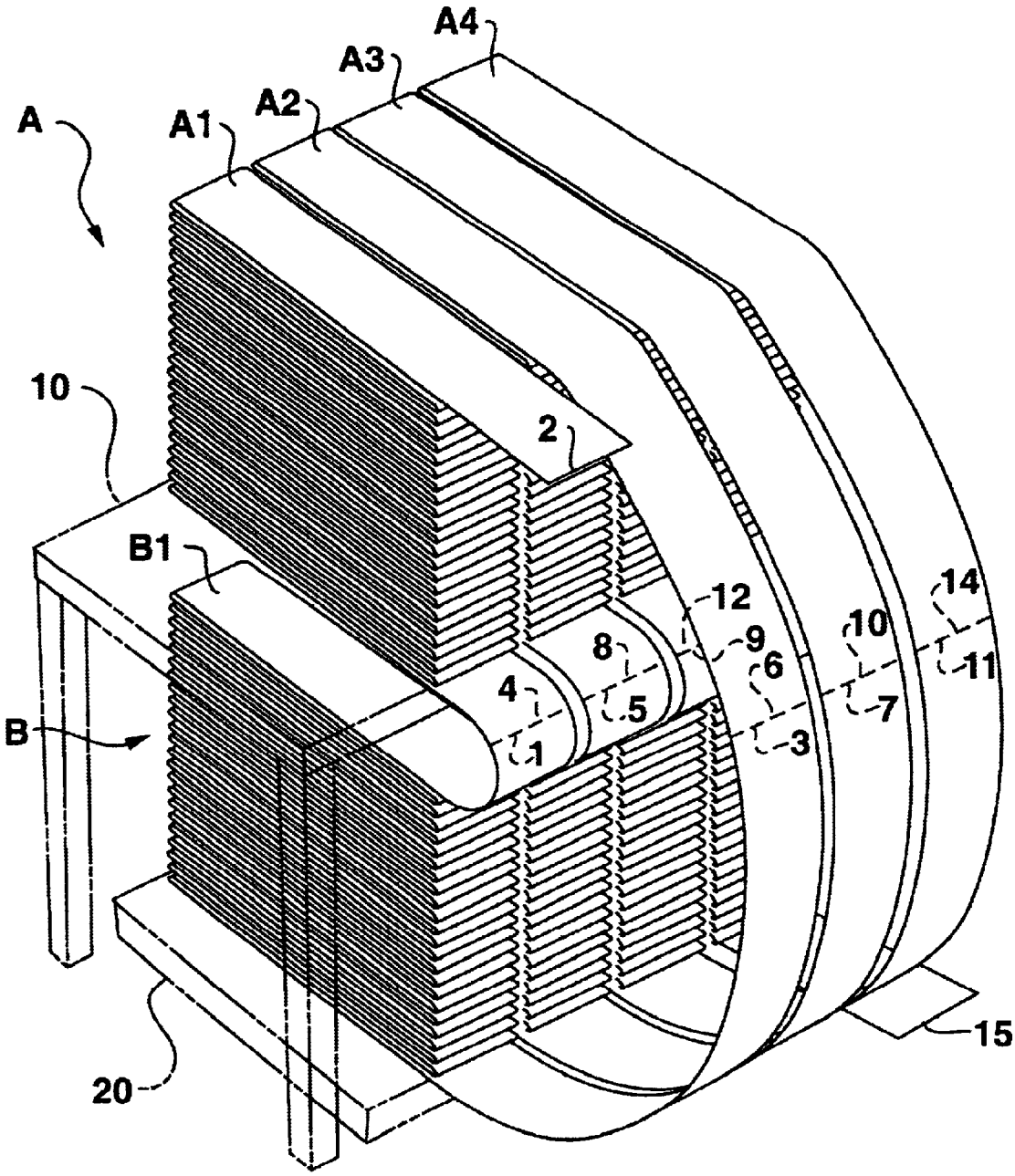
FIG. 1 is a perspective view of festooned multi-lane blocks spliced together in accordance with the method of the invention.

Reference will now be made in detail to one or more embodiments of the method according to the invention, at least one example of which is illustrated in the drawings. Each example and embodiment is provided by way of explanation of the invention, and not meant as a limitation of the invention. For example, features illustrated or described as part of one embodiment, may be used with another embodiment, to yield still a further embodiment. It is intended that the invention include these and other variations and modifications as come within the scope and spirit of the invention.

The invention relates to a process for splicing and feeding festooned strips of material from multi-lane blocks. The concept of festooned blocks is old in the art and need not be described in detail herein. In general, referring to the figures, blocks A and B of festooned material typically include multiple lanes of stacks A1–A4 and B1–B4 of the material. Each stack consists of a length of the material having a tail end and a lead end. The length of material has been folded in a back-and-forth fashion so as to form a stack of folded layers of the material, as generally illustrated in the figures.

The blocks A and B are generally formed on a support surface 20. The support surface 20 may be any suitable structure. In one particularly useful configuration of blocks A and B, the block is generally free standing on the horizontal support surface 20 and is wrapped in a film or other material until it is ready for use in a manufacturing process. The individual lanes or stacks may be perforated or completely separated. At that time, the film wrapping is cut away and the multi-lane blocks are generally free standing and unrestrained along the sides. However, it should be appreciated, that the present method is not limited to such configurations of multi-lane blocks. For example, the blocks may be housed or supported in any suitable support structure, such as a cage-like structure, single or multi-wall structure, etc. The present method according to the invention has utility with virtually any multi-lane block configuration.

Referring to FIG. 1, a first vertical configuration of blocks A and B is illustrated. Block A has been positioned vertically above block B and is supported on a suitable structure 10. Although not illustrated, the structure 10 may include wheels, rollers, or the like, to allow for easier positioning of block A. Block A is aligned above block B so that the corresponding stacks A1–A4 are aligned generally above stacks B1–B4.

The present method involves splicing the tail end of at least some of the stacks in block A to the lead end of at least some of the stacks in block B. The method of connecting or splicing the ends together is not a limiting feature of the invention. Any conventional splicing technique or device may be used in this regard, including adhesives, tape, thermal bonds, etc.

The method is not limited to splicing any particular number of stacks together or any particular sequence of splicing. For example, in one embodiment, the lead end of stack A1 may define the initial end of the spliced stacks that is to be fed initially into the manufacturing line or process. The tail end of stack A1 may be connected to the lead end of stack B1. Alternatively, the tail end of stack A1 may be connected to the lead end of stack B2, B3, B4, etc. Variations of the method according to the invention will be quite evident to those skilled in the art.

FIG. 1 illustrates blocks A and B spliced together in accordance with one embodiment of the method. Block A contains stacks A1–A4. Stack A1 has a lead end 2 and a tail end 4. Stack A2 has a lead end 6 and a tail end 8. Stack A3 has a lead end 10 and a tail end 12. Stack A4 has a lead end 14 and a tail end 16 (not visible). Similarly, stack B1 has lead end 1 and a tail end 3. Stack B2 has a lead 5 and a tail end 7. Stack B3 has a lead end 9 and a tail end 11. Stack B4 has a lead end 13 (not visible) and a tail end 15. In the illustrated example, the lead end 2 of stack A1 is the end designated to be fed to a manufacturing process. The tail end 4 of stack A1 is spliced to the lead end 1 of stack B1. The tail end 3 of stack B1 is spliced to the lead end 6 of stack A2. The tail end 8 of stack A2 is spliced to the lead end 5 of stack B2, and so forth. Thus, in this configuration, the tail ends of the stacks in block A are connected to lead ends of the aligned stacks in block B. The lead end 2 of stack A1 defines the lead end of the entire chain of spliced stacks, and the tail end 15 of stack B4 defines the end or tail of the entire chain of connected stacks.

Thus, in the manufacturing line or process, the stacks are consumed in alternating fashion between the blocks. Stack A1 is consumed first followed by stack B1. Stack A2 is then consumed followed by stack B2, and so forth. This particular embodiment is beneficial if all of the stacks from all of the interconnected blocks are to be fed to the same manufacturing machine or process.

Figure 3:
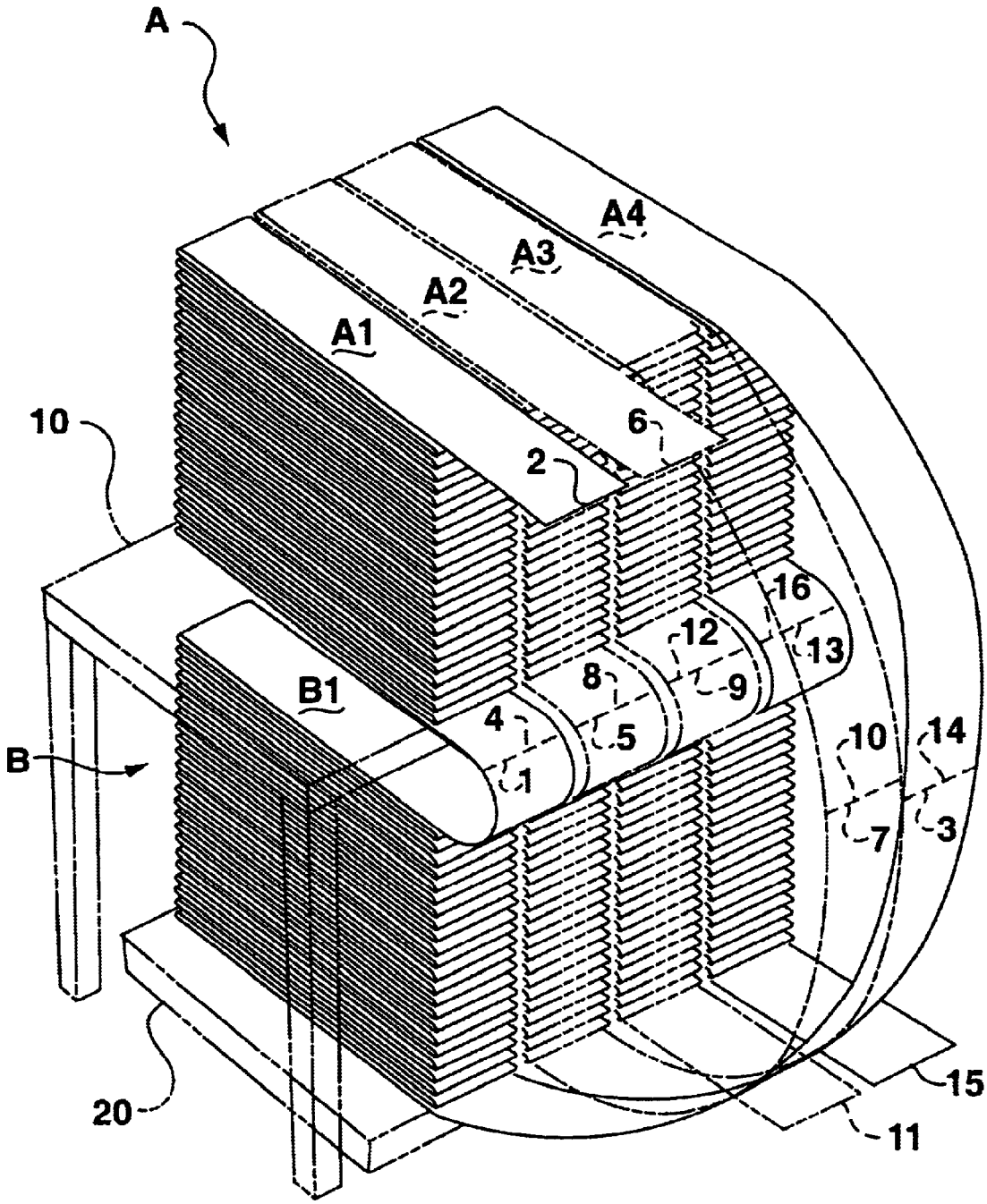
FIG. 3 is a perspective view of festooned multi-lane blocks spliced together according to an alternative method of the invention.
Figure 4:
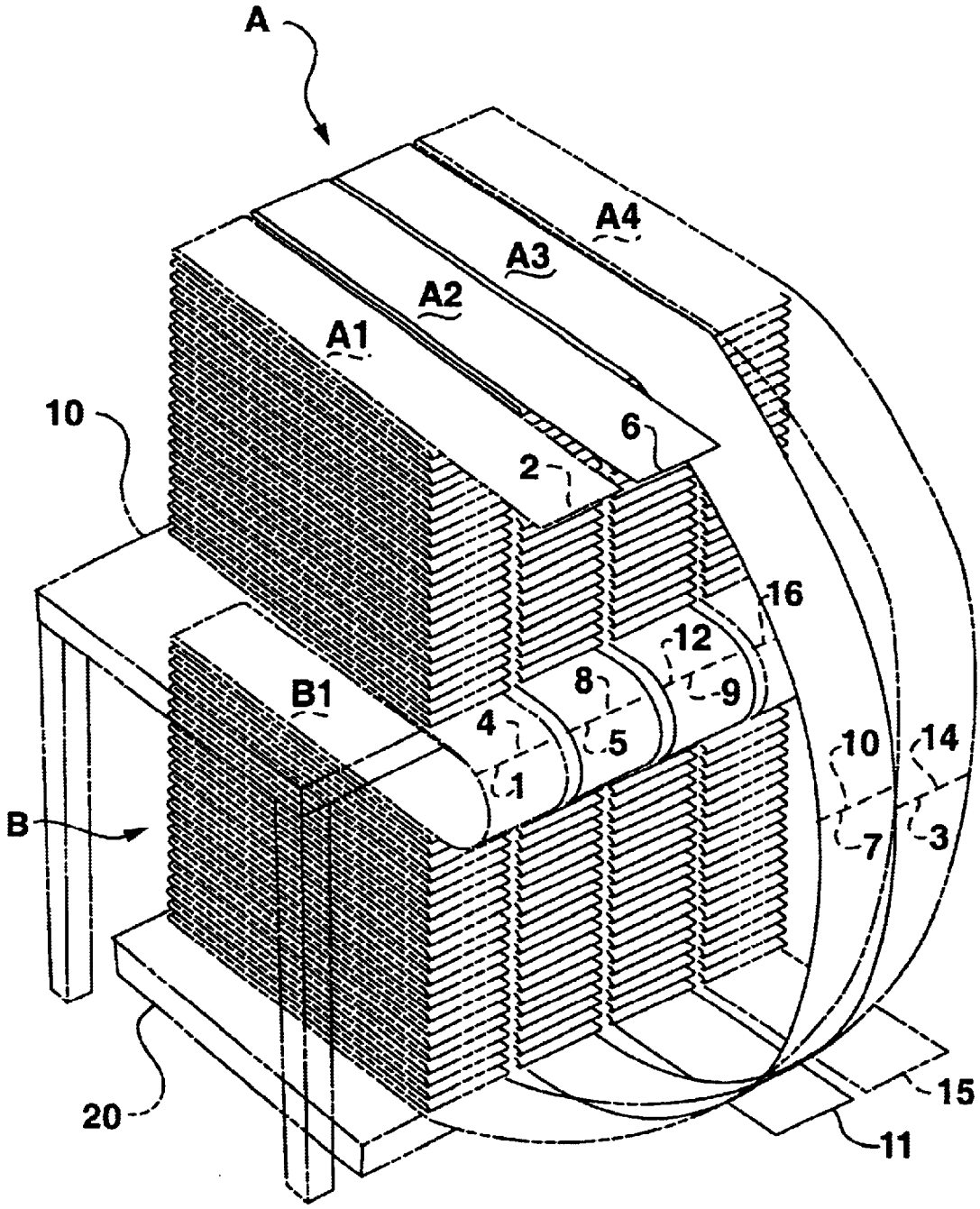
FIG. 4 is a perspective view of festooned multi-lane blocks spliced together in accordance with an alternate method of the invention.

In the vertical orientation of the blocks A and B as illustrated in FIGS. 1, 3, and 4, it should be understood that opposite face surfaces of the alternating stacks are spliced together. This is not a concern if the stack material is relatively uniform and the manufacturing line or process does not depend on any particular orientation of the material. For example, in the manufacturing of absorbent articles such as diapers, feminine care products, etc., the stack material may be strips of fibrous non-woven material that are uniform in the Z direction (thickness or depth of the material), and the article forming process does not depend on a particular orientation of the strip material face surfaces. However, in certain other manufacturing processes it may be necessary to maintain the same face orientation between the spliced stacks particularly if one face is covered with a film layer and the opposite face is not. In this case, it would be necessary to impart a 180 degree twist between each spliced together stack, as is commonly understood in the art.

Figure 2:
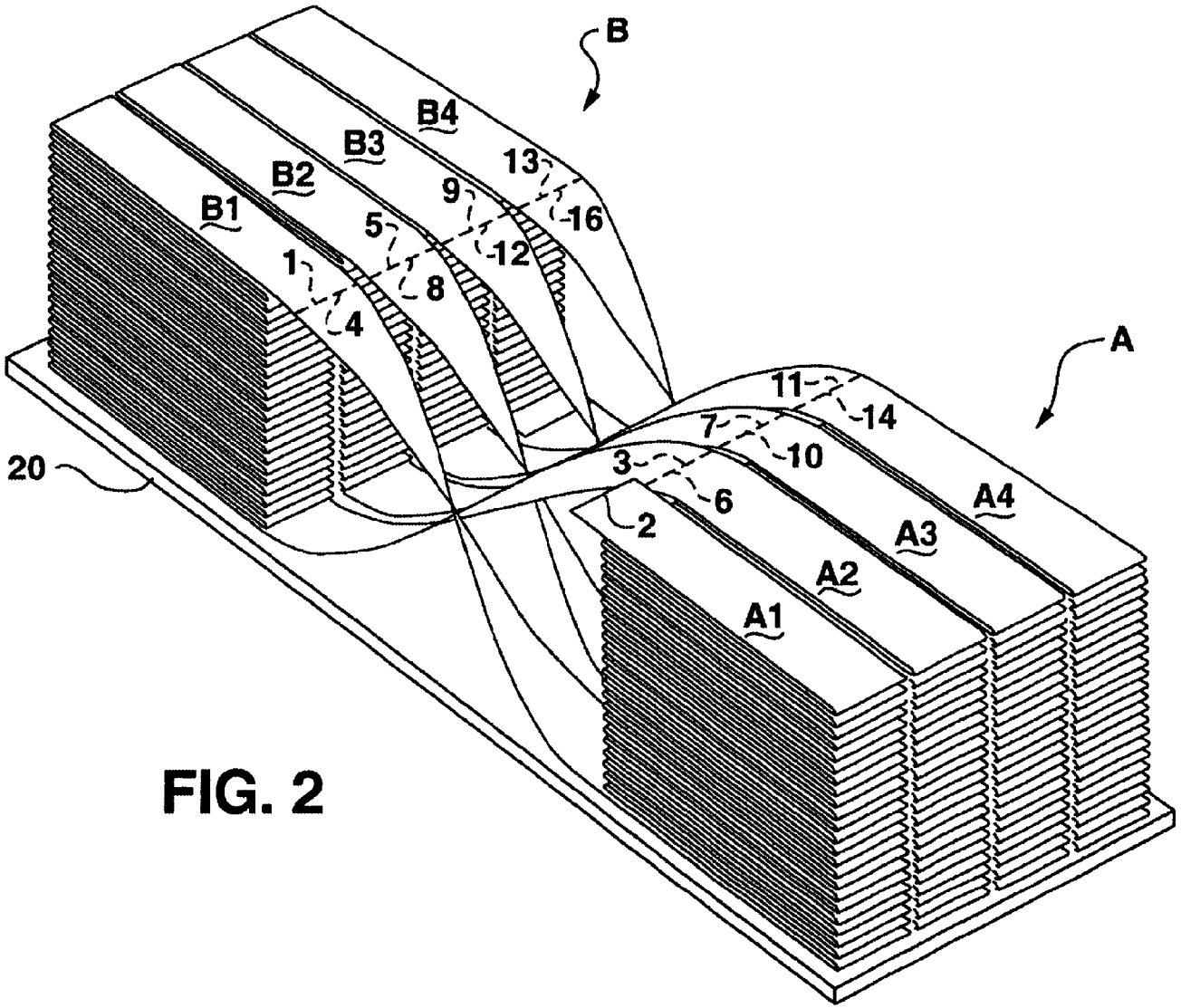
FIG. 2 is a perspective view of an alternate embodiment of the festooned multi-lane blocks spliced in accordance with the invention.

FIG. 2 illustrates an. alternative embodiment of the method according to the invention wherein the stacks A and B are disposed generally in a common horizontal plane. The stacks are disposed so that the sides thereof having the respective tail ends and lead ends available for splicing are facing each other. This embodiment is similar to that of FIG. 2 in that the stacks are alternately and sequentially spliced. For example, the tail end 4 of stack A1 is spliced to the lead end 1 of stack B1. The tail end 3 of stack B1 is spliced to the lead end 6 of stack A2, and so forth. As can be seen in FIG. 2, this configuration of the stacks results in a criss-cross pattern of the spliced tails and ends. So that the spliced sections can pass between each other, it is necessary to impart a twist in each spliced section. Thus, this embodiment may be particularly beneficial wherein it is necessary in the downstream manufacturing process or line that the entire chain of spliced stacks have the same face orientation.

In an alternate embodiment of the method according to the invention, multiple blocks A and B may be spliced to supply more than one manufacturing machine or processing line. This configuration may be beneficial wherein the stack material is not uniform between stacks. For example, the individual stacks or lanes may be cut in the machine direction from a single mat of material having an overall width corresponding generally to the width of a multi-lane block. Particularly in situations of fibrous non-woven mats and the like, it may be the case that the mat material is more or less dense in the middle portion thereof as compared to the side or edge portions. In this case, the outer stacks, such as stack A1 and A4, may contain material that is less or more dense than the inner stacks A2 and A3. Certain downstream manufacturing machines and processes may be particularly sensitive to any variations in the stack material and, thus, it may be that all of the stacks from a single block cannot be fed to the same manufacturing line or process. The present inventive method, however, provides a means to splice stacks from multiple blocks having the same or similar characteristics so that multiple blocks can simultaneously feed multiple downstream machines or processes. FIGS. 3 and 4 conceptually illustrate this embodiment. In FIG. 3, the outermost stacks of blocks A and B are spliced together in accordance with the method of the invention. The middle blocks may also be separately spliced together as indicated by the dashed lines. Referring to FIG. 3, it can be seen that the tail end 4 of stack A1 is spliced to the lead end 1 of stack B1. The tail 3 of stack B1 is spliced to the lead end 14 of stack A4. The tail 16 of stack A4 is spliced to the lead end 13 of stack B4. In this configuration, the lead end 2 of stack A1 would be fed to a manufacturing line or process and the stacks would be consumed in the following order: A1, B1, A4, B4.

The middle stacks A2, A3, B2, B3, may be spliced together and fed to a different machine or process. FIG. 4 represents how the middle stacks may be spliced together. The lead end 6 of stack A2 defines the lead end of the chain of connected stacks. The tail end 8 of stack A2 is spliced with the lead end 5 of stack B2. The tail end 7 of stack B2 is spliced to the lead end 10 of stack A3. The tail end 12 of stack A3 is spliced to the lead end 9 of stack B3. The tail end 11 of stack B3 defines the end of the connected chain of stacks. This chain may be fed to a machine or process separate from the outer connected stacks and would be consumed in the following order: A2, B2, A3, B3.

It should be appreciate that the present inventive method is not limited to splicing only two blocks. Any number of blocks may be spliced together in accordance with the method. For example, three separate blocks may be spliced wherein the tail end of the first stack of block 1 is spliced to the lead end of the first stack of block 2. The tail end of the first stack of block 2 is spliced to the lead end of the first stack of block 3. The tail end of the first stack of block 3 is spliced to the lead end of the second stack of block 1. The sequence is repeated until all of the stacks in the three blocks are alternately and sequentially connected. It should be apparent to those skilled in the art that various modifications may be made in connecting multiple blocks together in accordance with the method of the invention.

The method of the invention also may include the process of splicing the tail end of the last block in any combination of connected blocks with an additional source of festooned material. This additional source may be, for example, additional blocks of multi-lane stacks spliced together in accordance with the invention. These blocks may be pre-spliced and either stored or positioned in a stand-by staging area. At the appropriate time, the additional blocks are moved to the manufacturing line and the lead end of the spliced blocks is spliced to the tail end of the last stack of the last block being consumed.

It should be appreciated by those skilled in the art that various modifications and variations can be made in the method according to the invention for splicing multiple blocks of multi-lane stacks of festooned material together. The present invention includes all such modifications and variations.

What is claimed is:

1. A process for splicing and feeding festooned material, comprising:

a. providing a first multi-lane block of side-by-side stacks of the material, each stack having a leading end and a tail end;

b. providing at least a second multi-lane block of side-by-side stacks of the material in proximity to the first block, each stack in the second block having a leading end and a tail end;

c. splicing the tail end of the first stack of the first block to the leading end of the first stack of the second block;

d. splicing the tail end of the first stack of the second block to the leading end of the second stack of the first block;

e. repeating the alternating splicing sequence of steps (c) and (d) for subsequent stacks until all of the stacks of the first block and the second block have been alternately spliced such that tail ends of the stacks in the first block are spliced with the lead ends of the stacks in the second block, and the tail ends of the stacks in the second block are spliced with the lead ends of the stacks in the first block; and f. providing the leading end of the first stack of the first block as the initial end for a manufacturing process.

2. The process as in claim 1, further comprising splicing the tail end of the last stack of the second block to an additional source of festooned material.

3. The process as in claim 1, wherein the additional source of festooned material is at least two additional blocks of multi-lane side-by-side stacks spliced together in accordance with steps (c)–(e), and comprising splicing the tail end of the last stack of the second block to the lead end of the first stack of the first block of the additional blocks.

4. The process as in claim 3, comprising splicing the additional blocks as the first and second blocks are being consumed in the manufacturing process and delivering the additional spliced blocks to the manufacturing line prior to the last stack of the second block being consumed.

5. The process as in claim 1, comprising orienting the first and second blocks in a vertical configuration.

6. The process as in claim 5, wherein the tail ends of the stacks in the upper block are adjacent to the lead ends of the stacks in the lower block.

7. The process as in claim 1, comprising orienting the first and second blocks in a common horizontal plane.

8. The process as in claim 7, wherein the blocks are oriented such that a side of a block having the tail ends and lead ends exposed for splicing is facing the same respective side of the other block.

9. A process for splicing and feeding festooned material, comprising:

providing multiple blocks of side-by-side stacks of the material, each stack in each block having a leading end and a tail end;

splicing stacks of all of the blocks together in alternating fashion such that a stack from one block is spliced to a stack of another block; and delivering the spliced blocks to a manufacturing line and providing an unspliced leading end of a stack of one of the blocks as the initial end for a manufacturing process.

10. The process as in claim 9, comprising splicing stacks together between the blocks such that the tail ends of the stacks in one block are spliced to lead ends of stacks in an adjacent block.

11. The process as in claim 9, wherein only two blocks are spliced together and comprising splicing the tail ends of the stacks in the adjacent block to the lead ends of stacks in the one block.

12. The process as in claim 9, wherein more than two blocks are spliced together and comprising splicing the tail ends of the stacks in the adjacent block to the lead ends of stacks in a third block.

13. A process for splicing and feeding festooned material, comprising:

providing multiple blocks of side-by-side stacks of the material, each stack in each block having a leading end and a tail end;

splicing stacks of all of the blocks together in alternating fashion such that a stack from one block is spliced to a stack of another block;

delivering the spliced blocks to a manufacturing line and providing an unspliced leading end of a stack of one of the blocks as the initial end for a manufacturing process; and wherein less than all of the stacks of a first block are spliced to stacks of a second block to define a first source of spliced stacks for a first manufacturing machine or process, and the remaining stacks of the first block are spliced to stacks from the second or a different block to define a second source of spliced stacks for a second manufacturing machine or process.

14. The process as in claim 13, wherein the remaining stacks of the first block are spliced to the remaining stacks of the second block.

15. The process as in claim 13, wherein the first and second sources of sliced stacks are distinguished by a varying physical characteristic.

16. The process as in claim 15, wherein the first and second sources differ in one of weight, density, or component make-up of the material.

17. The process as in claim 13, wherein the first and second sources of spliced stacks are spliced according to relative position within the blocks.

* * * * *